US005546094A

United States Patent [19]

Egashira

[11] Patent Number: 5,546,094

[45] Date of Patent: Aug. 13, 1996

[54] TELESCOPIC ANTENNA FOR PORTABLE TELEPHONES

[75] Inventor: Yoshimi Egashira, Kanagawa, Japan

[73] Assignee: Harada Kogyo Kabushiki Kaisha, Tokyo, Japan

[21] Appl. No.: 280,837

[22] Filed: Jul. 26, 1994

[30] Foreign Application Priority Data

Jul. 26, 1993 [JP] Japan ..... 5-183837

[51] Int. Cl.[6] ..... H01Q 1/24

[52] U.S. Cl. ..... 343/702; 343/900; 343/828

[58] Field of Search ..... 343/702, 715, 343/725, 901, 900, 846, 828, 856; H01Q 1/24

[56] References Cited

U.S. PATENT DOCUMENTS 4,868,576 9/1989 Johnson, Jr. ..... 343/702
4,958,382 9/1990 Imanishi ..... 343/702
5,245,350 9/1993 Sroka ..... 343/702

*Primary Examiner*—Michael C. Wimer
*Assistant Examiner*—Tan Ho
*Attorney, Agent, or Firm*—Koda and Androlia

[57] ABSTRACT

An antenna mount 31 consisting of a hollow bulging member is formed so as protrude locally from the top of a portable telephone housing 30. A first antenna 10 with an electrical length of λ/4 is provided inside the antenna mount so that the base end Q of the first antenna is connected to a feeder cable 15. A second antenna 20 with an electrical length of 3 λ/4 is installed parallel to the first antenna 10 at a prescribed distance from the first antenna so that the second antenna can be freely extended from and retracted into the housing 30 via the antenna mount 31 and so that the base end 23 of the second antenna 20 is connected to the earthing means 32 of the housing 30 when the second antenna is extended from the housing 30, thus providing a J-form antenna formed by the first and second antennas 10 and 20. It is desirable that the first and second antennas 10 and 20 each be equipped with an element-shortening means.

2 Claims, 7 Drawing Sheets

TELESCOPIC ANTENNA FOR PORTABLE TELEPHONES

BACKGROUND OF THE INVENTION

1. Field of the Invention

The present invention relates to a telescopic antenna for a so-called "hand-held type" portable telephone which is installed in the portable telephone for receiving call signals and transmitting and receiving ultrashort waves for the purpose of communications with correspondents.

2. Prior Art

FIGS. 7(*a*) and (*b*) respectively show conventional examples of telescopic antennas for portable telephones.

The telescopic antenna for a portable telephone shown in FIG. 7(*a*) is constructed in the following manner: an external antenna 2 consisting of a whip antenna is attached to the upper wall of the portable telephone housing 1 in such a manner that the antenna 2 is freely inserted into and extended from the housing 1. An internal antenna 3 for receiving incoming calls which responds to call signals is mounted inside the housing 1, and these external and internal antennas 2 and 3 are connected via a change-over switch 4 that performs a change-over operation linked to the telescopic operation of the external antenna 2, so that selective change-over operation is performed with respect to a transmitter-receiver 5 installed inside the housing 1.

In the telescopic antenna for the portable telephone shown in FIG. 7(*b*), an external antenna 2 consisting of a whip antenna is, as in the case of FIG. 7(*a*), attached to the upper side wall of the portable telephone housing 1 so that the antenna 2 can be freely inserted into and extended from the housing 1. An inverted F-form antenna 6, which doubles as an impedance matcher and an internal antenna, is provided inside the housing 1. The F-form antenna 6 is electrostatically coupled to the external antenna 2 via a capacitance 7. When the external antenna 2 is extended (or extended from the housing), the inverted F-form antenna 6 is caused to act as an impedance matcher. When the external antenna 2 is retracted (or pushed into the housing), the inverted F-form antenna 6 is caused to act as an internal antenna for incoming calls.

In both of these conventional antennas shown in FIGS. 7(*a*) and (*b*), the internal antenna used for incoming calls is installed inside the portable telephone housing 1. As a result, the housing 1 needs to have a relatively large internal volume. Such an increase in the size of the housing 1 runs counter to the compactness and reduced weight, which are strongly demanded as essential features of portable telephones, and should therefore be avoided as much as possible.

Furthermore, as to the current distribution on the conventional antennas when the external antenna 2 is extended from the housings, it is found that the current distribution is based on the top of the housing 1, regardless of the electrical length of the antenna (3λ/8, 5λ/8, 3λ/4, etc.) that corresponds to the wavelength of the telephone waves used. In other words, electromagnetic waves are radiated directly from the top of the housing 1.

In the conventional antenna-installed portable telephones constructed as described above, some of the electromagnetic waves emitted by the antenna radiate into the human body (especially into the head, which is close to the antenna) when the portable telephone is held in the hand and the receiver is placed against the ear. As a result, some of the radiant energy is absorbed and attenuated by the heat, etc., so that there is a danger that the sensitivity of the portable telephone will drop during use. Recently, electromagnetic waves at gigahertz frequencies have been used as telephone waves. Accordingly, it is feared that the radiation of such high electromagnetic waves may have a deleterious effect on the human body.

SUMMARY OF THE INVENTION

The object of the present invention is to provide a telescopic antenna for a portable telephone wherein: the internal volume of the main body of the housing can be reduced, so that there is no danger of any interference with the compactness and light weight of the portable telephone; the radiating portion of the antenna is located at a height of approximately λ/4 or greater above the top of the housing, so that there is no danger that the radiated electromagnetic waves will have a deleterious effect on the human body, and so that any drop in the sensitivity of the antenna that might be caused by the absorption or attenuation of radiant energy by the human body can be prevented; the antenna is safe and simply constructed; and the antenna is superior in performance.

The following means are adopted in the present invention in order to solve the problems and accomplish the object:

(a) In particular, the telescopic antenna for a portable telephone according to the present invention comprises: an antenna mount consisting of a hollow bulging member which is installed so as to protrude locally from the top of a portable telephone housing; a first antenna which is provided inside the antenna mount with the base end of the first antenna connected to a feeder cable and has an electrical length set at λ/4, where (lambda) is the wavelength of the electromagnetic waves in the frequency band used; and a second antenna which is installed parallel to the first antenna at a prescribed distance from the first antenna and provided so as to be retracted into and extended from said housing via the antenna mount, the second antenna being provided with a base end to be connected to an earthing means of the housing when the second antenna is extended from the housing and having an electrical length set at 3 λ/4. When the second antenna is extended from the housing, a J-form antenna is formed by the first and second antennas; and when the second antenna is accommodated inside the housing, an internal antenna which is used for incoming calls is formed by the first antenna alone.

(b) In addition, in the telescopic antenna for a portable telephone according to the present invention, the first and second antennas are respectively provided with an element-shortening means such as a loading coil, etc. at least at the base ends of the antennas.

As a result of adopting the means described above, the following effects are obtained:

(a) The present invention is constructed so that the first antenna, which is an internal antenna, is provided inside the antenna mount consisting of the hollow bulging member which protrudes locally from the top of the housing. Accordingly, the internal volume of the main body of the housing can be reduced, and there is no danger of any conflict with the compactness and light weight of portable telephones.

During use, because of the mutual relationship between the first antenna, which is provided inside the antenna mount consisting of the hollow bulging member, and the second antenna, which is installed parallel to the first antenna, the current distributions of the first and second antennas are mutually canceled up to a height of λ/4 (approximately 40 mm) above the top of the housing, and electromagnetic waves are not radiated from this region. As a result, deleterious effects on the human head, which is located near the antenna when the telephone is used, can be avoided. Furthermore, the radiating part of the antenna is raised to the upper portion of the second antenna (i.e., the region higher than λ/4 above the top of the housing). Accordingly, the absorption and attenuation of radiant energy by the head of the user are reduced, and the radiation pattern in the horizontal plane is improved, leading to an increased sensitivity during communications.

In addition, when the second antenna is pulled out, a so-called "J-form" antenna is formed by the first antenna, which is in a state that the tip impedance of the antenna is close to infinitely large, and by the second antenna, which is installed so that it is parallel to and coupled with the first antenna. Accordingly, the antenna can be used as a non-grounded type antenna.

Furthermore, there is no need to connect the component elements via a change-over switch or to mutually insulate the inverted F-form antenna and external antenna in order to obtain an electrostatic coupling of the antennas as seen in the prior art. Thus, the antenna of the present invention has a simple structure.

Moreover, when the second antenna is pulled out, the base end of the second antenna is connected to the earthing means of the housing. Accordingly, even if a special protective (withstand voltage) means against static electricity invading the system via the second antenna is not installed, static electricity is prevented from invading the electronic circuitry of the transmitter-receiver. Thus, damage to expensive transistors, etc. can be prevented.

(b) Meanwhile, if the first and second antennas are equipped with an element-shortening means such as base loading system, etc., the lengths of the base portions of the first and second antennas can be set at lengths which are also desirable from the standpoint of external appearance. More specifically, if the height to which the radiating part of the antenna is raised remains at λ/4 (approximately 40 mm), the radiated electromagnetic waves of such an antenna has no deleterious effect on the human body, and there is little drop in sensitivity that is caused by raising the radiating part of the antenna. In this case, however, the total length (height) of the antenna mount consisting of the hollow bulging member which protrudes locally from the top of the portable telephone housing becomes offensively conspicuous. Nonetheless, in the antenna equipped with the element-shortening means, not only does the antenna cause no deleterious effect on the human body nor a drop in sensitivity, but it is also possible to control the electrical length of the antenna to a minimum length (height), e.g., approximately 20 mm, which is desirable from the standpoint of the external appearance of the portable telephone as well.

BRIEF DESCRIPTION OF THE DRAWINGS

FIG. 1(*a*) showing the antenna of the embodiment with the second antenna extended, and FIG. 1(*b*) showing the antenna of the embodiment with the second antenna retracted.

DETAILED DESCRIPTION OF THE INVENTION

Figure 1A:
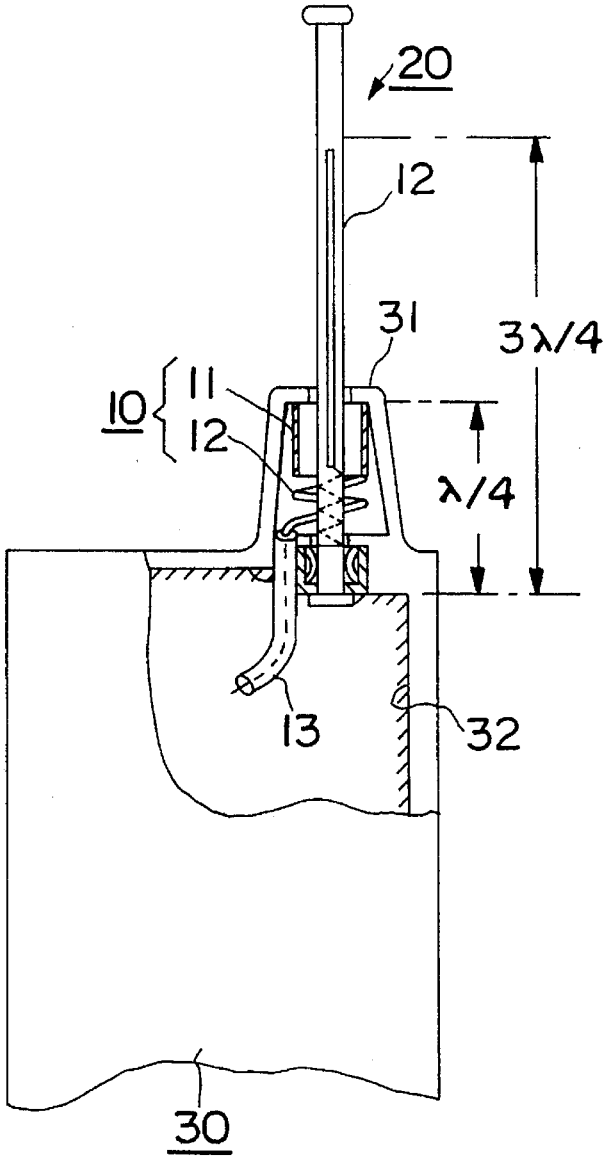
FIGS. 1*a* and 1*b* illustrates the structure of one embodiment of the portable telephone telescopic antenna of the present invention.
Figure 1B:
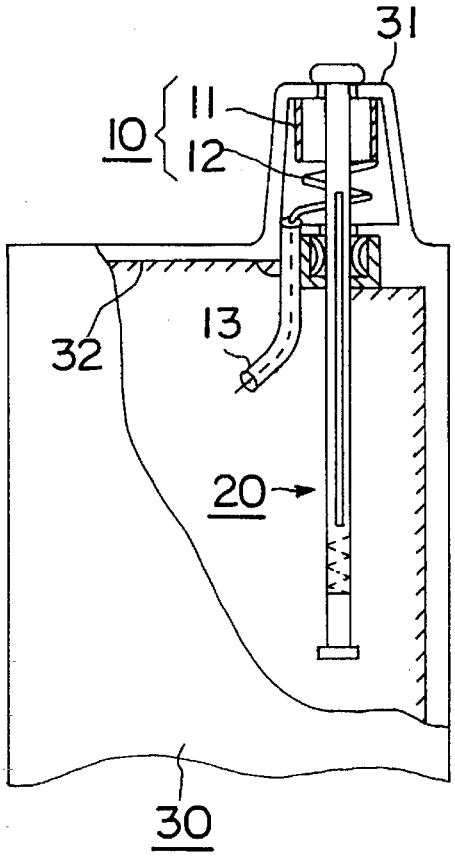
Figure 2:
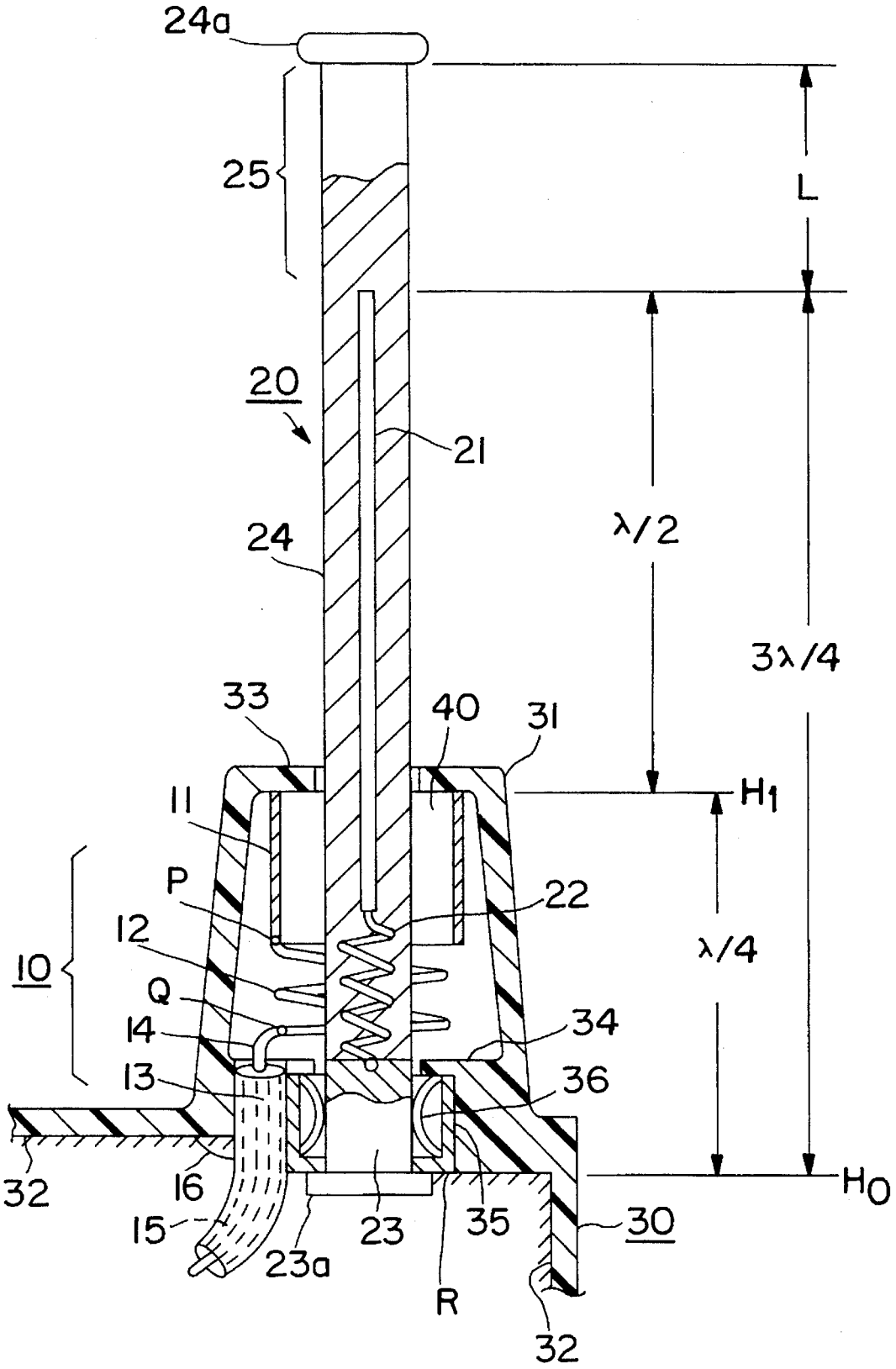
FIG. 2 illustrates the cross section of the essential portion of the concrete structure of the portable telephone telescopic antenna shown in FIG. 1 in greater detail.

FIGS. 1(*a*) and (*b*) illustrate schematically the structure of the telescopic antenna for a portable telephone according to one embodiment of the present invention. FIG. 1(*a*) shows the structure with the second antenna extended, and FIG. 1(*b*) shows the structure with the second antenna retracted. FIG. 2 shows, in a concrete manner, a cross section of the structure of the portable telephone telescopic antenna shown in FIGS. 1(*a*) and (*b*) in greater detail.

As seen from FIGS. 1 and 2, the antenna of this embodiment is constructed so that base loading type first and second antennas 10 and 20 are provided in the upper part of a portable telephone housing 30 so as to form a so-called "J-form" antenna. A concrete description will be given below:

An antenna mount 31 consisting of a hollow bulging member having the shape of a truncated cone is installed so that it protrudes locally from the top of the portable telephone housing 30. A shielding conductive film 32 is formed on the inner surface of the housing 30 by a finishing means such as conductive paint, etc. The first antenna 10 is provided inside the antenna mount 31 that is a hollow bulging member.

The first antenna 10 uses the base loading system. More specifically, the upper end of a ring-form conductor 11 made of a metal pipe, etc. is connected to the inner surface of the top wall 33 of the antenna mount 31, and one end P of a loading coil 12 is connected to the lower end of this ring-form conductor 11. The central conductor 14 of a coaxial cable 13 which is brought into the antenna mount 31 from the interior of the portable telephone housing 30 through an opening made in the bottom wall 34 of the antenna mount 31 is connected to the other end Q of the loading coil 12. The outer conductor 15 of the coaxial cable 13 is connected via a conductor 16 to a portion, which is near the end Q of the loading coil 12, of the shielding conductive film 32 that constitutes an earthing means of the housing 30. The earthing means of the housing can be other than the film such as a metal shielding case, a ground plane, etc. which are not shown in the Figures. The first antenna 10 is designed so that its electrical length is λ/4, where λ is the wavelength of the electromagnetic waves in the frequency band used.

The second antenna 20 is installed parallel to the first antenna 10 at a prescribed distance from the first antenna 10. More specifically, in this embodiment, the second antenna 20 is coaxial in the axial center of the ring-form conductor 11 and loading coil 12. Furthermore, the second antenna 20 is installed so that it can be freely inserted into and withdrawn from the housing 30 via through-holes which are opened in the top wall 33 and bottom wall 34 of the antenna mount 31.

Like the first antenna 10, the second antenna 20 uses a base loading system. In other words, the second antenna 20 includes: a flexible rod-form conductive wire 21; a loading coil 22, the tip end thereof being connected to the base end of the conductive wire 21; a cylindrical conductive body 23, the tip end thereof being connected to the base end of the loading coil 22; and a flexible insulator 24 made of a synthetic resin, etc. and integrally molded in the form of a cylinder so that the above components above are put into an integral unit. In addition, a base end flange 23*a* which prevents the second antenna 20 from slipping out in the direction of the tip end of the antenna is formed at the base end of the cylindrical conductive body 23, and a top end flange 24*a* which prevents the second antenna 20 from slipping out in the direction of the base end of the antenna is formed at the top end of the flexible insulator 24. The second antenna 20 is designed so that its electrical length is $3\lambda/4$, where $\lambda$ is the wavelength of the electromagnetic waves in the frequency band used. Furthermore, the second antenna 20 includes a top area 25 which is formed near the top end of the second antenna 20 and has the length L. The top area 25 is an extended area formed so as to block electrical coupling. Thus, the second antenna 20 has no electrical effect on the first antenna 10 when the second antenna 20 is retracted into the housing 30.

Furthermore, a collar 35 is mounted on the inner circumferential surface of the through-hole formed in the bottom wall 34 of the antenna mount 31. The collar 35 is made of a conductive material in the shape of a cylinder with a bottom. One end R of this bottom-equipped cylindrical collar 35 is connected to the shielding conductive film 32 which is the earthing means of the housing 30. A contact spring 36 made of a metal material such as phosphorus bronze, etc. is mounted on the inner side of the collar 35. The contact spring 36 is mounted so as to press against the outer circumferential surface of the second antenna 20. In this way, the second antenna 20 is mechanically held at a prescribed extended/retracted position by the sliding frictional force between the contact spring 36 and the second antenna 20. In addition, when the second antenna 20 is fully extended from the housing 30, electrical continuity is maintained between the base end of the second antenna 20 and the shielding conductive film 32, which is the earthing means of the housing 30, by the contact between the cylindrical conductive body 23 of the second antenna 20 and the contact spring 36, so that earthing is accomplished.

Furthermore, in the antenna of this embodiment, it is designed so that a shuber top is obtained by positioning an open end 40, at which the impedance Z is infinitely large, at a position $H_1$ which is in the housing 30 and located at a distance of $\lambda/4$ above the ground plate position $H_0$. In addition, in this embodiment, the current distributions on the first antenna 10 and second antenna 20 cancel each other in the region that is between the ground plate position $H_0$ and the position $H_1$ which is located at a distance of $\lambda/4$ above the ground plate position; and only the upper portion, excluding the $\lambda/4$ length, of the second antenna 20 participates in the radiation of electromagnetic waves and thus functions as an antenna element. In other words, in this embodiment, a J-form antenna obtained in which the first antenna 10 is the exciting side and the second antenna 20 is the excited side.

The operation and effect of the antenna of this embodiment which is constructed as described above will be given below with reference to FIGS. 3(*a*) and (*b*). When the second antenna 20 is extended, i.e., when the second antenna 20 is extended from the housing 30, the current distributions at the portions of the first and second antennas 10 and 20 which are from the ground plate position $H_0$ to the position $H_1$ located at a distance of $\lambda/4$ above the ground plate position $H_1$ have opposite phases and equal magnitudes as indicated by the broken lines in FIG. 3(*a*), because of the mutual relationship between the first and second antennas 10 and 20. As a result, these current distributions at such portions can cancel each other. Furthermore, the impedance at the open end 40 becomes maximum (infinitely large). Accordingly, only the upper portion of the second antenna 20, i.e., the portion of the antenna 20 that has the length $\lambda/2$, contributes to the radiation of electromagnetic waves, and such a portion of the second antenna 20 acts as a non-grounded type antenna.

Figure 3A:
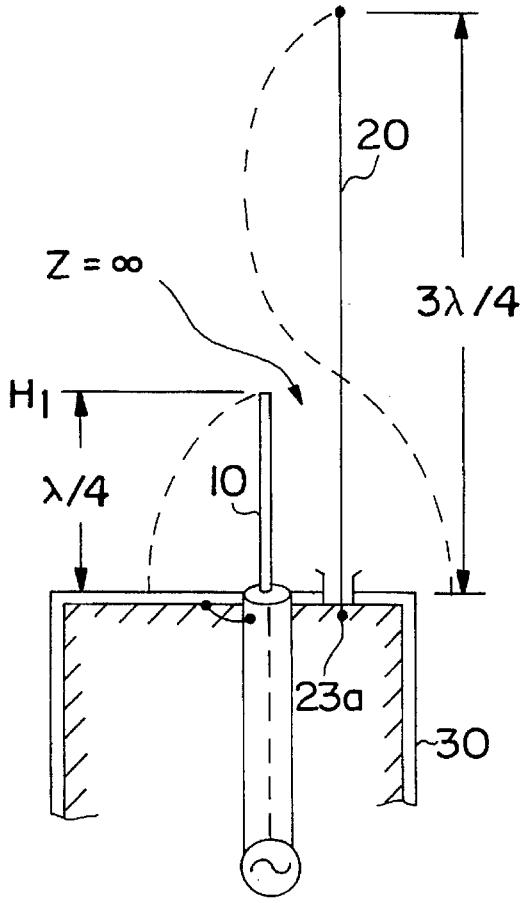
FIGS. 3*a*and 3*b* illustrates the explanatory diagram of the operation and effects of the portable telephone telescopic antenna of the embodiment.
Figure 3B:
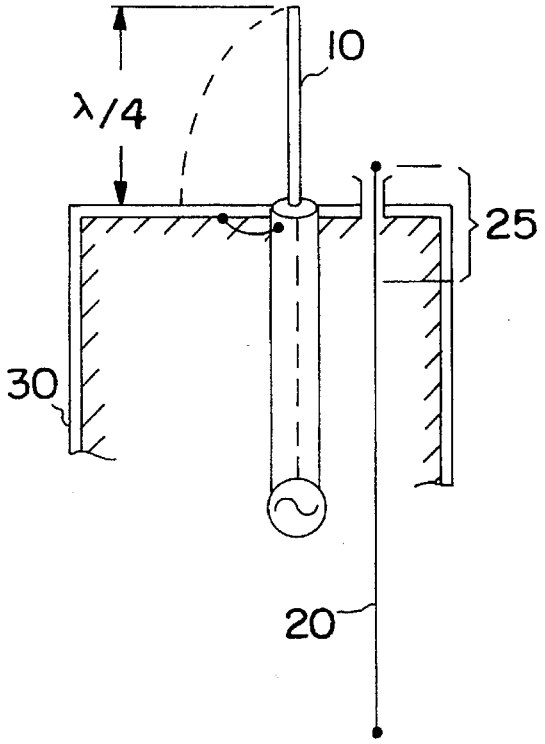

When the second antenna 20 is retracted into the housing 30, i.e., when the second antenna 20 is inside the housing, as shown in FIG. 3(*b*), the portion of the second antenna 20 which is located below the top area 25 and actually acts as an antenna element is brought to a position which is slightly below the base end of the first antenna 10. As a result, the second antenna 20 is now in a state in which it is virtually independent from the first antenna 10. In other words, the two antennas 10 and 20 are brought into a non-coupled state. Accordingly, the first antenna 10 acts as a grounded type antenna which has an electrical length of $\lambda/4$ and thus acts effectively as an internal antenna for incoming calls.

As described above, in the antenna of this embodiment, the first antenna 10 which constitutes an internal antenna is provided inside the antenna mount 31 that is a hollow bulging member formed to protrude locally from the top of the portable telephone housing 30. Accordingly, the internal volume of the main body of the housing can be reduced, and there is no danger of any interference with the compactness and light weight of the portable telephone.

Furthermore, during the use, because of the mutual relationship between the first antenna 10 which is provided inside the antenna mount 31 and the second antenna 20 which is installed parallel to the first antenna, the current distributions of the first and second antennas 10 and 20 are mutually canceled in the region which is from the top of the housing 30 to the point at height $\lambda/4$ (or approximately 40 mm). Thus, the electromagnetic waves are not radiated from this region. As a result, deleterious effects on the human head located near the antenna can be avoided. Furthermore, since the radiating part of the antenna is raised to the upper portion of the second antenna, which is the region $\lambda/4$ above the top of the housing, the absorption and attenuation of radiant energy by the head of the user are reduced, and the radiation pattern in the horizontal plane can be improved, increasing sensitivity during communications.

When the second antenna 20 is pulled out, a so-called "J-form" antenna is formed by the first antenna which is in a state that the tip end impedance is close to infinitely large and by the second antenna 20 which is parallel to and coupled with the first antenna 10. Accordingly, the antenna can be used as a non-grounded type antenna.

Figure 7A:
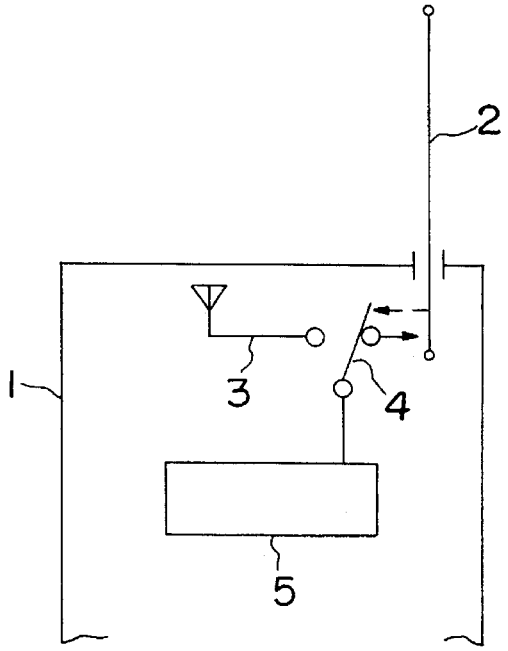
FIG.7(a) PRIOR ART
FIGS. 7(*a*) and (*b*) show respectively examples of conventional antenna structures.
Figure 7B:
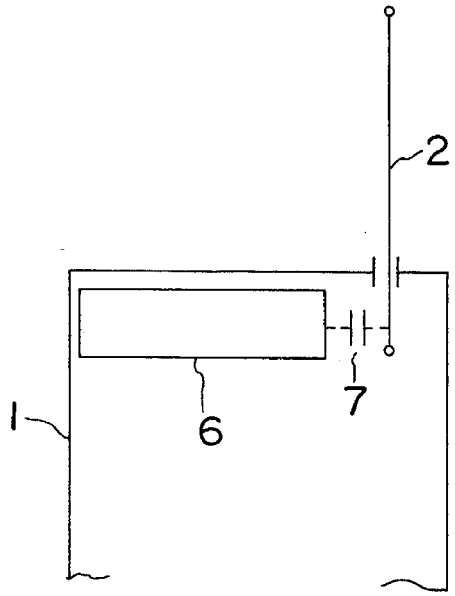
FIG.7(b) PRIOR ART

Moreover, in the antenna of this embodiment, there is no need to connect the antenna to the transmitter-receiver 5 via a change-over switch 4 or to mutually insulate an inverted F-form antenna 6 and external antenna 2 in order to make an electrostatic coupling of the antennas via the capacitance 7 as in the conventional examples shown in FIG. 7. Accordingly, the antenna of the present invention is extremely simple in the structure. In addition, when the second antenna 20 is pulled out, the base end of the second antenna is connected to the shielding conductive film 32, which is the earthing means of the housing 30, via the base end flange 23*a*. As a result, static electricity entering from the outside through the second antenna 20 when the antenna 20 is extended can be prevented from entering into the electronic circuitry of the transmitter-receiver even if no special protective (withstand voltage) means is used against such static electricity. Accordingly, damage to expensive transistors, etc. can be prevented in other words, the antenna offers the advantage of a high degree of safety obtained with a simple structure.

Meanwhile, if the first and second antennas 10 and 20 are equipped with an element-shortening means such as a base loading system, etc., the lengths of the base parts of the first and second antennas 10 and 20 can be set at lengths which are also desirable from the standpoint of external appearance. More specifically, if the height to which the radiating part of the antenna is raised is set at $\lambda/4$ (or approximately 40 mm) from the housing, the antenna has no radiated electromagnetic waves which have a deleterious effect on the human body, and there is little drop in sensitivity. In this case, however, the total length (or the height) of the antenna mount 31 consisting of a hollow bulging member which protrudes locally from the top of the portable telephone housing 30 becomes offensively conspicuous. Nonetheless, in the antenna equipped with the element-shortening means, not only does the antenna have no deleterious effect on the human body and little drop in sensitivity, but it is also possible to control the electrical length of the antenna to a minimum length (height), e.g., approximately 20 mm, which is permissible from the standpoint of the external appearance of the portable telephone as well.

Figure 4A:
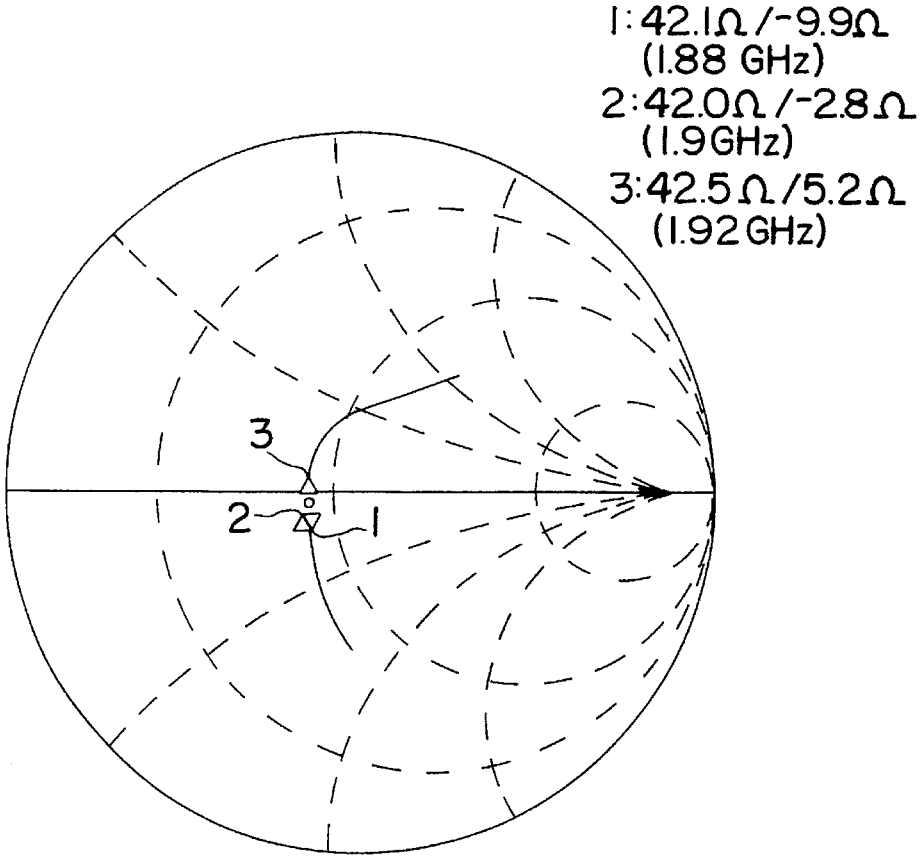
FIGS. 4*a* and 4*b* illustrates the actual measurements of the impedance characteristics when the second antenna of the portable telephone telescopic antenna of the embodiment is extended pulled out, wherein FIG. 4(*a*) is a Smith chart, and FIG. 4(*b*) is a VSWR characteristic curve diagram.
Figure 4B:
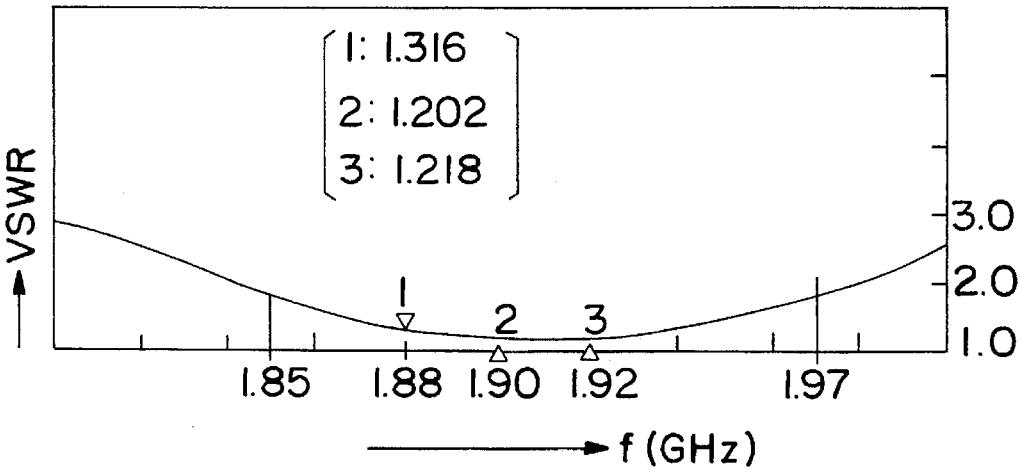

FIGS. 4(*a*) and (*b*) show the actual measurements of the impedance characteristics when the second antenna 20 is extended (or pulled out). FIG. 4(*a*) is a Smith chart, and FIG. 4(*b*) is a VSWR characteristic curve diagram. As shown in FIG. 4(*b*) a VSWR value of 1.8. or less is obtained through the broad band extending from 1.85 to 1.97 GHz, thus indicating sufficient broad-band characteristics.

Figure 5A:
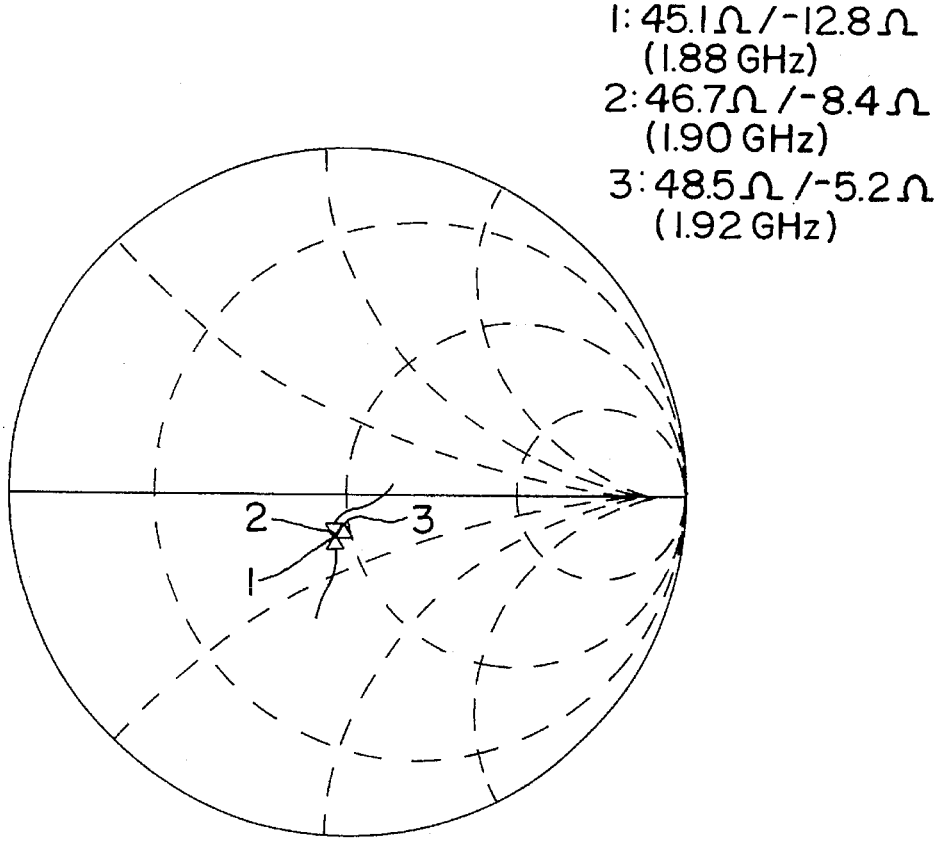
FIGS. 5*a* and 5*b* illustrates the actual measurements of the impedance characteristics when the second antenna of the portable telephone telescopic antenna of the embodiment is retracted (stored), wherein FIG. 5(*a*) is a Smith chart, and FIG. 5(*b*) is a VSWR characteristic curve diagram.
Figure 5B:
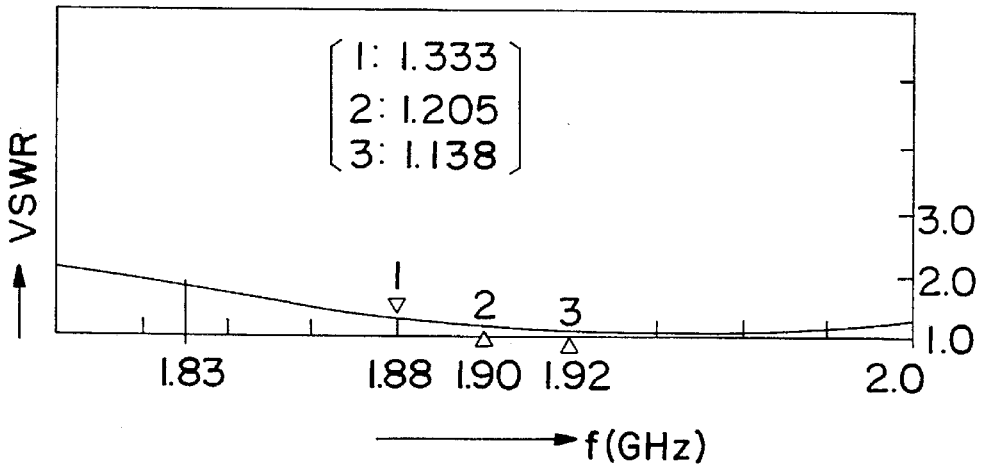

FIGS. 5(*a*) and (*b*) show the actual measurements of the impedance characteristics when the second antenna 20 is retracted (or stored). FIG. 5(*a*) is a Smith chart, and FIG. 5(*b*) is a VSWR characteristic curve diagram. As shown in FIG. 5(*b*), a VSWR value of 1.8 or less is obtained through the broad band extending from 1.83 to 2.0 GHz, thus indicating sufficient broad-band characteristics.

Figure 6A:
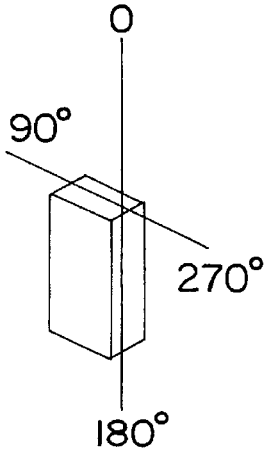
FIGS. 6*a* and 6*b* illustrates the actual measurements of the radiation pattern in the vertical plane when the second antenna of the portable telephone telescopic antenna of the embodiment is extended (pulled out), wherein FIG. 6(*a*) is a diagram showing the angles in the vertical plane, and FIG. 6(*b*) is a diagram of the radiation pattern.
Figure 6B:
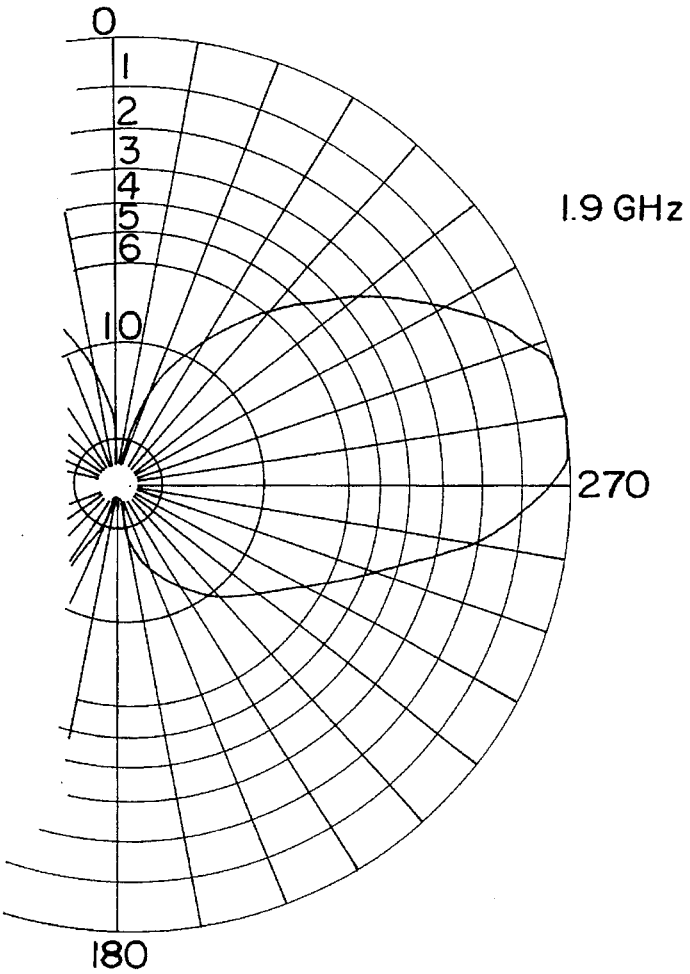

FIGS. 6(*a*) and (*b*) show the actual measurements of the radiation pattern in the vertical plane when the second antenna 20 is extended (or pulled out). FIG. 6(*a*) is a diagram which shows the angles in the vertical plane, and FIG. 6(*b*) is a diagram of the radiation pattern. As shown in FIG. 6(*b*), the pattern is oriented roughly in the horizontal direction, exhibiting a more or less ideal value.

The present invention is not limited to the embodiment described above, and various modifications may be made.

(1) It would be possible to form a conductive film on the inner circumferential surface of the antenna mount by a finishing means such as vacuum evaporation, etc. instead of using the ring-form conductor 11 for the first antenna 10. Such an arrangement is advantageous in that it can reduce the amount of work involved in assembling the first antenna 10 and thus simplifies manufacture.

(2) It would also be possible to use a rod-form conductor instead of the ring-form conductor 11 for the first antenna 10 and to install the rod-form conductor 11 parallel to the second antenna 20. Such an arrangement is advantageous because it simplifies the structure of the first antenna 10.

(3) It would also be possible to completely eliminate the ting-form conductor 11 or a part used in place of the ting-form conductor of the first antenna 10 and use a helical type antenna consisting only of the loading coil 12 as the first antenna 10. This arrangement further simplifies the structure of the first antenna 10.

(4) The first and second antennas 10 and 20 do not need necessarily to be equipped with an element-shortening means. The first antenna 10 can be formed only with the ring-form conductor 11 or a substitute element, and the second antenna 20 can be formed with the rod-form conductive wire 21 alone. In this case, the antenna mount 31 needs to be higher compared to a case where the antennas are equipped with an element-shortening means, though the structure itself is simplified.

In the present invention, the antenna mount that consists of a hollow bulging member is provided so as to protrude locally from the top of the portable telephone housing, a first antenna with an electrical length of $\lambda/4$ is provided inside the antenna mount so that the base end of the first antenna is connected to a feeder cable, a second antenna with an electrical length of $3\lambda/4$ is installed parallel to the first antenna at a prescribed distance from the first antenna so that the second antenna can be freely retracted into and extended from the housing via the antenna mount, and the base end of the second antenna is brought to be connected to the earthing means of the housing when the second antenna is extended from the housing. In addition, it is so designed that when the second antenna is extended, a J-form antenna is formed by the first and second antennas, and when the second antenna is retracted and inside the housing, an internal antenna for incoming calls is formed by the first antenna alone. It is preferable that the first and second antennas be equipped with an element-shortening means such as a base loading system, etc.

Thus, according to the present invention, in a telescopic antenna for a portable telephone: the internal volume of the main body of the housing can be small; there is no danger of any interference with the compactness and light weight of the portable telephone; there are no deleterious effects of radiated electromagnetic waves on the human body, and no drop occurs in the sensitivity of the antenna caused by the absorption or attenuation of radiant energy by the human body, since the radiating portion of the antenna is located at a height of approximately $\lambda/4$ or higher above the top of the housing; the antenna has a simple structure and a high degree of safety; and the antenna offers a superior performance.

I claim:

1. A telescopic antenna for portable telephones characterized in that said antenna comprises:

an antenna mount consisting of a hollow bulging member which is installed so as to protrude locally from a top of a portable telephone housing;

a first antenna which is provided inside said antenna mount with a base end of said first antenna connected to a feeder cable, said first antenna having an electrical length set at $\lambda/4$, where $\lambda$ is a wavelength of electromagnetic waves in a frequency band used; and a second antenna which is set parallel to said first antenna at a prescribed distance from said first antenna and is provided in said housing so as to be extended from and retracted into said housing through said antenna mount, a base end of said second antenna being connected to an earthing means provided in said housing when said second antenna is extended from said housing, and said second antenna having an electrical length set at 3 $\lambda/4$, wherein when said second antenna is extended from said housing, a J-form antenna is formed by said first and second antennas, and when said second antenna is retracted into said housing, an internal antenna which is used for incoming calls is formed by said first antenna alone.

2. A telescopic antenna for portable telephones according to claim 1 characterized in that said first and second antennas are respectively equipped with an element-shortening means at least at a base end thereof.

* * * * *